US005913516A

United States Patent [19]

Piotrowski et al.

[11] Patent Number: 5,913,516

[45] Date of Patent: Jun. 22, 1999

[54] MULTIMODE TARGET WITH VARIABLE TRAJECTORY BALL RAMP

[76] Inventors: Peter J Piotrowski; Brad D. Cornell; Dwight Sullivan, all of 3401 N. California, Chicago, Ill. 60618

[21] Appl. No.: 09/016,899

[22] Filed: Feb. 2, 1998

[51] Int. Cl.[6] ..... A63F 7/30

[52] U.S. Cl. ..... 273/127 R; 273/121 A

[58] Field of Search ..... 273/118 R, 118 A, 273/118 D, 119 R, 119 A, 121 R, 121 A, 127 R, 127 B

[56] References Cited

U.S. PATENT DOCUMENTS

| | | |
|---|---|---|
| 4,773,646 | 9/1988 | Joos, Jr. et al. . |
| 4,892,309 | 1/1990 | Kim et al. . |
| 4,991,846 | 2/1991 | Sondej . |
| 5,120,058 | 6/1992 | Trudeau et al. . |
| 5,120,059 | 6/1992 | Oursler . |
| 5,123,647 | 6/1992 | Lawlor et al. . |
| 5,181,722 | 1/1993 | Krutsch et al. . |
| 5,186,462 | 2/1993 | Biagi et al. . |
| 5,322,283 | 6/1994 | Ritchie et al. . |
| 5,529,294 | 6/1996 | Nordman et al. . |
| 5,533,726 | 7/1996 | Nordman et al. . |
| 5,580,052 | 12/1996 | Popadiuk et al. . |

*Primary Examiner*—Raleigh Chiu

*Attorney, Agent, or Firm*—Rudnick & Wolfe; Michael L. Kenaga; R. Blake Johnston

[57] ABSTRACT

A play feature for a pinball game features a multimode target with a variable trajectory ball ramp. The multimode target features a pair of distinct targets mounted upon the playfield of the pinball game in a rotating fashion. The multimode target may be rotated between positions whereby each of the distinct targets is exclusively accessible by the game ball thus providing the pinball game with more than one mode of play. A variable trajectory ball ramp is positioned upon the playfield and is curved and banked towards the multimode target. A pinball properly negotiating the ramp may strike the multimode target so as to increase the player's score. The multimode target may oscillate and the distinct targets may feature a number of sub-targets as well as oscillating barriers.

18 Claims, 4 Drawing Sheets

MULTIMODE TARGET WITH VARIABLE TRAJECTORY BALL RAMP

BACKGROUND

The invention relates generally to amusement devices in the form of rolling ball or pinball games and, more particularly, to a multimode play feature for such games.

A typical pinball game includes an inclined playfield with a number of play features arranged thereon. The player of the game operates flippers to direct a pinball at the play features to accumulate points and control the play of the game. Pinball games are typically coin or token operated and thus must be designed to attract player interest in order to be profitable. A key factor in the appeal of pinball games is the novelty and challenge offered by their play features. Accordingly, there is a constant need for pinball game manufacturers to develop new and unique play features which both entertain and challenge players.

One strategy employed by pinball game manufacturers is to provide pinball games with more than one mode of play. More specifically, such games offer the player an initial selection of targets (in the first mode) and later, after the player has obtained a certain score or accessed specific play features, the games enter a second mode featuring a different selection of targets. An example of such a game is disclosed by U.S. Pat. No. 4,773,646 to Joos, Jr. et al.

Pinball games with more than one mode of play are desirable because they are able to offer increased levels of difficulty in accordance with the player's level of skill. For example, the selection of targets offered during the second mode of game play may be more challenging than the initial selection of targets. This is an advantage as it allows one game to be enjoyed by both novice and advanced players.

Accordingly, it is an object of the present invention to provide a challenging and novel play feature that offers multimode play.

It is a further object of the present invention to provide a multimode play feature that offers modes with differing levels of difficulty.

SUMMARY

The present invention is directed to a play feature for a pinball game that includes a multimode target with a variable trajectory ball ramp. The multimode target features initial and alternative targets that are mounted "back to back" in a rotatable fashion upon the playfield of the pinball game. As a result, the multimode target may be positioned so that only the initial target is accessible by the game ball. Alternatively, the multimode target may be rotated so that only the alternative target is accessible by the game ball.

A variable trajectory ball ramp is provided on the playfield and is curved and banked towards the multimode target. As a result, the player may use the pinball game flippers to direct the game ball up the ramp and towards the multimode target. Different ball velocities and entrance angles result in variable trajectories. By striking the multimode target with the pinball, the player accumulates points and controls the play of the game.

The alternative target may be divided into a number of sub-targets. In addition, the alternative target may feature moving barriers, such as simulated swinging arms, that a player must "shoot" through in order to strike the alternative target with the game ball. The alternative target may also be oscillated so as to offer the player a moving target.

For a more complete understanding of the nature and scope of the invention, reference may now be had to the following detailed description of embodiments thereof taken in conjunction with the appended claims and accompanying drawings.

DESCRIPTION

Figure 1:
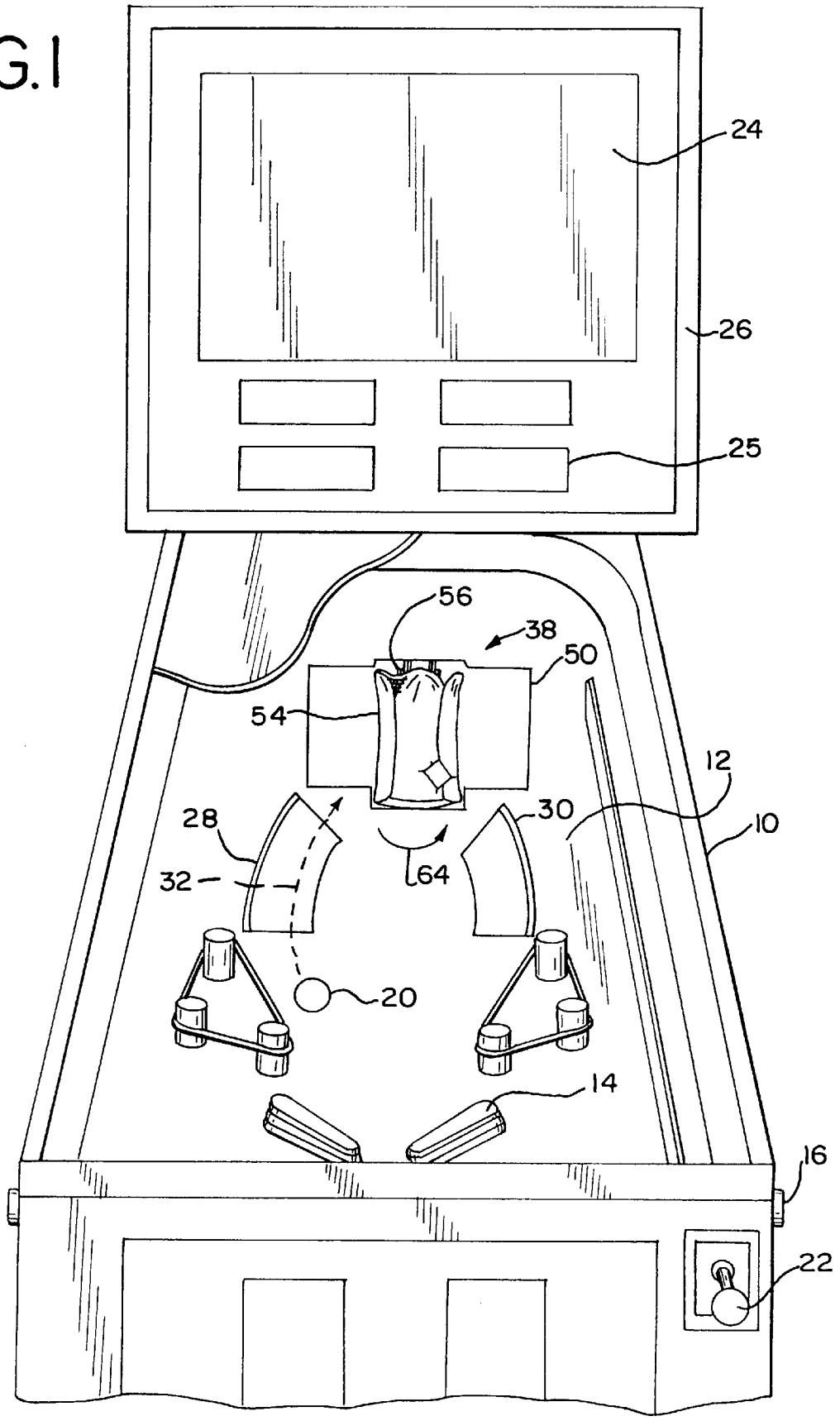
FIG. 1 is a perspective view of a pinball game featuring an embodiment of the play feature of the present invention with the multimode target in its initial position.

Referring to FIG. 1, a pinball game is shown that features an embodiment of the play feature of the invention. The pinball game is housed in a game cabinet 10 and features an inclined playfield 12. A pair of pivoting flippers 14 are positioned at the bottom of the inclined playfield 12 and are actuated by the player via manipulation of flipper control switches 16. As is known in the art, game ball 20 is introduced onto playfield 12 by way of a shooter 22 or its equivalent. After entering the playfield 12, ball 20 rolls towards the player by the force of gravity. The player actuates flippers 14 so that they contact ball 20 thus propelling and directing it towards targets on the playfield. Game progress is indicated by displays 24 and 25 which are positioned on back box 26.

As shown in FIG. 1, disposed upon playfield 12 are one or more variable trajectory ball ramps, indicated at 28 and 30. The ramps are positioned upon playfield 12 so that a ball 20 may be propelled by contact with one of the flippers 14 up one of the ramps, along a path such as the one indicated by dashed arrow 32. By properly negotiating ramps 28 or 30, a player is able to strike a multimode target, indicated generally at 38, and accumulate points. It is to be noted that the positions shown for ramps 28 and 30 and multimode target 38 are for illustrative purposes only and that many alternative positions for both components on playfield 12 are possible.

Figure 2:
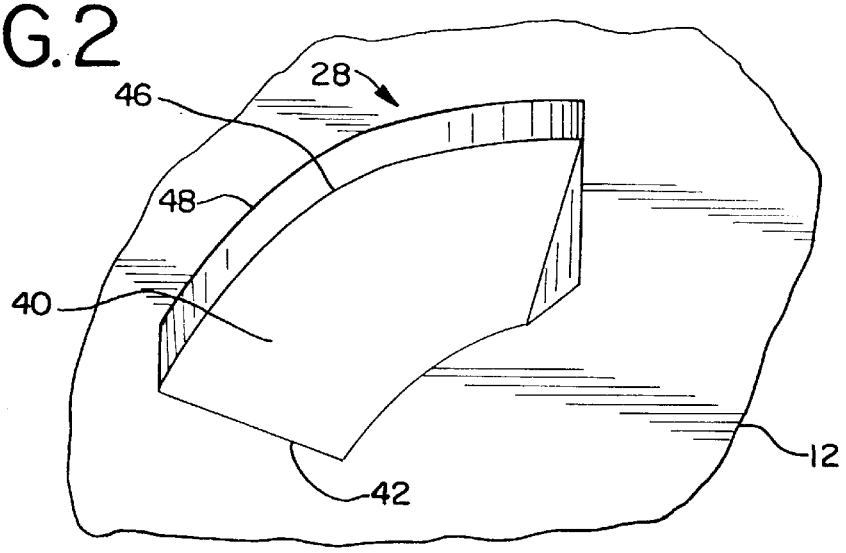
FIG. 2 is a perspective view of the left variable trajectory ball ramp of FIG. 1.

As shown in FIG. 2, variable trajectory ball ramp 28 features a ramp surface 40 that meets playfield 12 along its lower end 42. The outer side 46 of ramp 28 rises so that an outer portion of ramp surface 40 is elevated above playfield 12. Ramp surface 40 is curved and banked so that a ball traversing it is redirected as shown by path 32 in FIG. 1. A guard rail 48 preferably borders outer side 46 so that game balls are prevented from traveling sideways off of ramp 28. Ramp 30, which is the mirror image of ramp 28, features a similar construction.

A game ball 20 encountering ramps 28 or 30 is thus redirected and elevated. The degree of redirection and elevation of game ball 20, and thus its trajectory upon leaving ramps 28 or 30, depends upon its speed and initial direction upon entering the ramp. Because the player controls the speed and direction of game ball 20 with flippers 14, she or he is able to influence the ball trajectory.

Returning to FIG. 1, positioned near the discharge end of ramps 28 and 30 is multimode target 38. Multimode target 38, in the illustrated embodiment, features a vertically extending back board 50. An initial target, such as punching bag 54, is suspended from back board 50 by hinge 56. During the initial mode of game play, illustrated in FIG. 1, the player is faced with the challenge of propelling game ball 20, via flippers 14 and ramps 28 or 30, with the proper trajectory so that it strikes punching bag 54.

Figure 3:
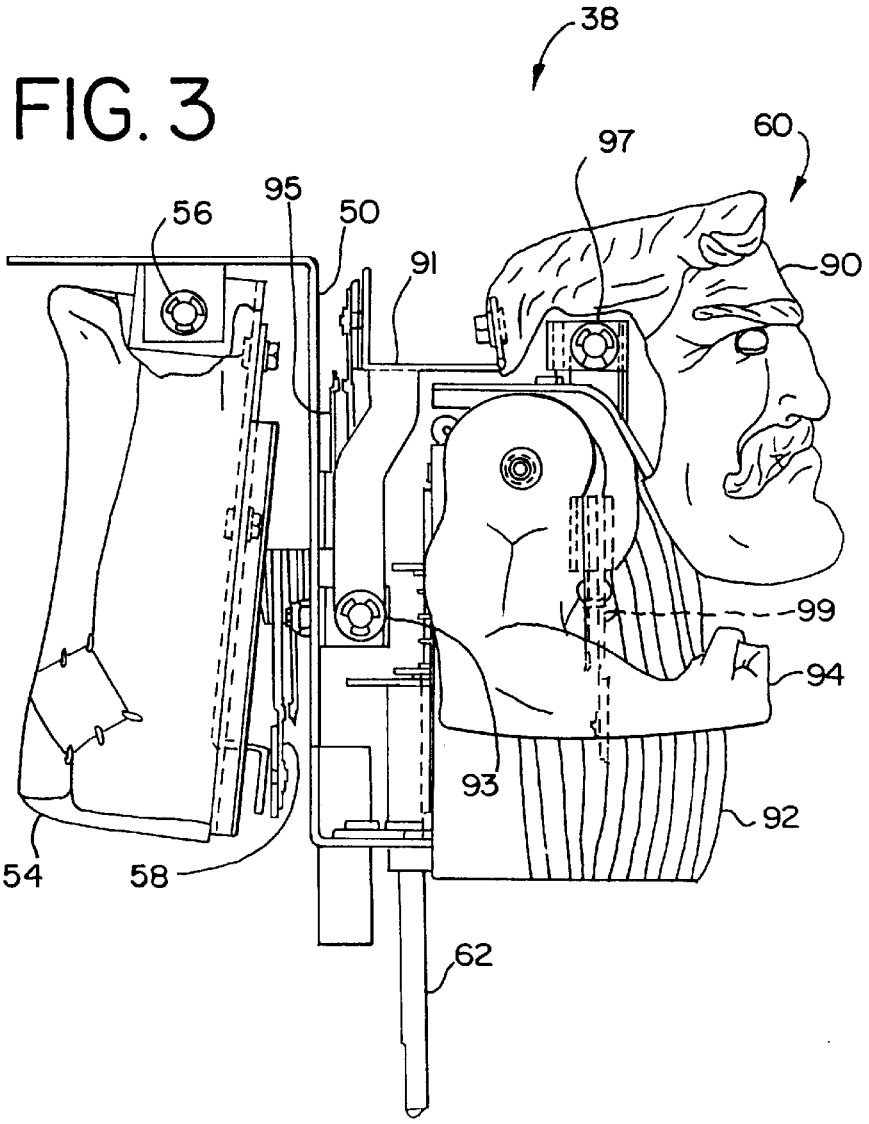
FIG. 3 is a side view of the multimode target of FIG. 1.

Referring to FIG. 3, punching bag 54 has associated therewith a spring-loaded contact switch 58 that is in communication with the game microprocessor (not shown). As a result, when punching bag 54 is struck by game ball 20, it pivots on hinge 56 so that switch 58 is momentarily closed and the player's game score is increased by the game microprocessor.

The opposite side of back board 50 features an alternative target such as a boxer, indicated generally at 60. Accordingly, when a player has reached a predetermined score, or has fulfilled a similar requirement, multimode target 38 is rotated 180° on shaft 62, as illustrated by arrow 64 in FIG. 1, so that the alternative mode of the game may be played. In the alternative mode (FIG. 4) the boxer 60 replaces the punching bag as the target. While two alternative targets, that is, punching bag 54 and boxer 60, are presented as an example, it should be noted that it is within the scope of the invention to provide three or more alternative targets. In such instances, the targets could be accessed by rotating multimode target 38, for example, 120° (for three alternative targets) or 90° (for four alternative targets).

Boxer 60 features three basic parts: a head 90, a body 92 and arms 94. Head 90 and body 92 are configured to form a pair of "sub-targets" as follows. Head 90 is attached to a linkage 91 which in turn is connected to back board 50 by a hinge 93. A spring-loaded contact switch 95 is connected between linkage 91 and back board 50 so that it is momentarily closed when the boxer head 90 is struck with a pinball. Similarly, boxer body 92 is attached by a hinge 97 to a support 98 (FIG. 5A). A spring-loaded contact switch 99 is attached between boxer body 92 and support 98. As a result, contact switch 99 is momentarily closed when boxer body 92 is contacted with the game ball. Both contact switches 95 and 99 are in communication with the game microprocessor so that the player's score is increased when they are closed.

Figure 4:
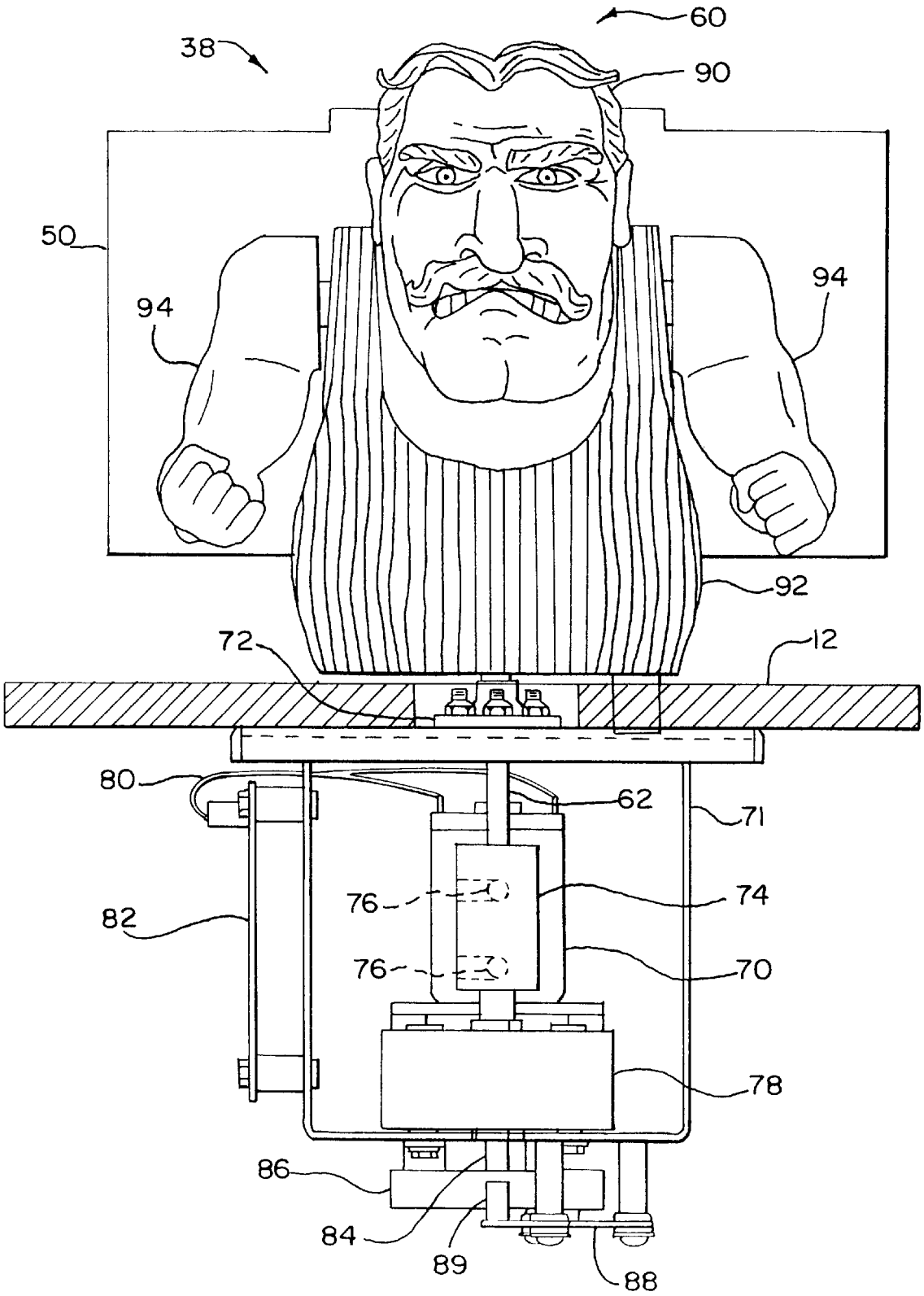
FIG. 4 is a front view of the multimode target of FIG. 1 in its alternative position showing the game playfield in cross-section and the electric motor and linkages associated with the multimode target.

Referring to FIG. 4, multimode target 38 is rotated via an electric motor 70 that is mounted to the bottom of playfield 12 by bracket 71. More specifically, shaft 62 passes through a bearing 72 positioned within playfield 12 and is received by coupling 74. Shaft 62 is held within coupling 74 by a pair of set screws 76. Coupling 74 and shaft 62 are turned by a gearbox 78 which is driven by electric motor 70 (positioned behind coupling 74 in FIG. 4). Electric motor 70 is energized through lines 80 as dictated by motor control circuit board 82 and the game microprocessor. A second shaft 84 is also turned by gearbox 78. Second shaft 84 is connected to a position wheel 86 which is in communication with a position circuit board 88 via roller 89. As a result, position circuit board 88 detects the position/mode of multimode target 38 and communicates this information to the game microprocessor.

The target during the alternative mode, involving boxer 60, is preferably designed to be more challenging than the target during the initial mode (the punching bag). This allows the novice player to enjoy the initial mode yet also provides advanced players with an alternative mode featuring a challenge that is more compatible with their skill level. This makes the game interesting and enjoyable for both novice and advanced players. In addition, the potential to play the alternative mode may motivate novice players to "practice" playing the game until they are able to reach the alternative mode. Such practice would obviously increase game revenues.

As with the initial mode, during the alternative mode the player is faced with the challenge of propelling the game ball, via flippers and ramps 28 or 30 (FIG. 1), with the proper trajectory so that it strikes boxer 60. Boxer 60 provides, however, a number of additional features that make it a more challenging target than punching bag 54 (FIG. 1). More specifically, boxer 60 features barrier or blocking arms 94 that may oscillate. Movement of arms 94 in such a manner provides moving barriers that the player must "shoot" past in order to strike boxer 60. In addition, boxer 60 may be oscillated through an arc of roughly 90° by electric motor 70. This provides the player with a moving target. During such modes of operation, the player's timing in contacting the game ball with the flippers becomes an additional challenge. Furthermore, the alternative mode (or "boxer mode") could be divided up into two or three sub-modes where the boxer's arms 94 and the boxer 60 itself are moving and not moving. This would, in effect, give the game three or four modes of play.

Figure 5B:
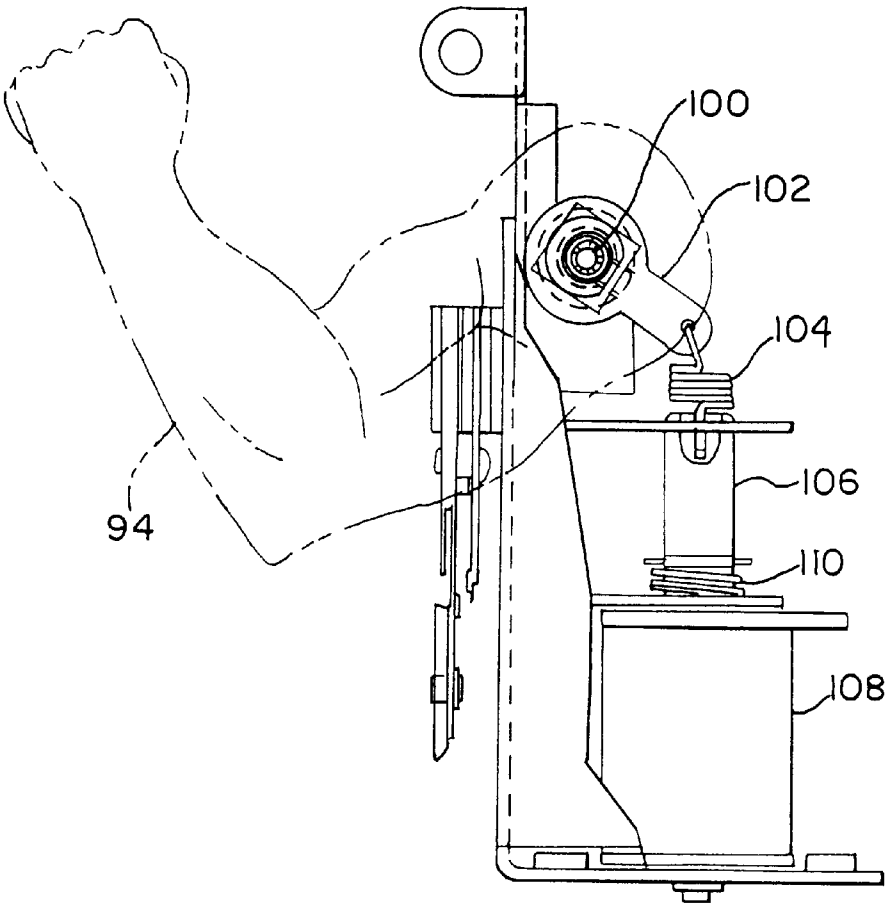
FIGS. 5A and 5B are side views showing the articulation of the arm linkages and solenoids for the boxer of FIG. 4.
Figure 5A:
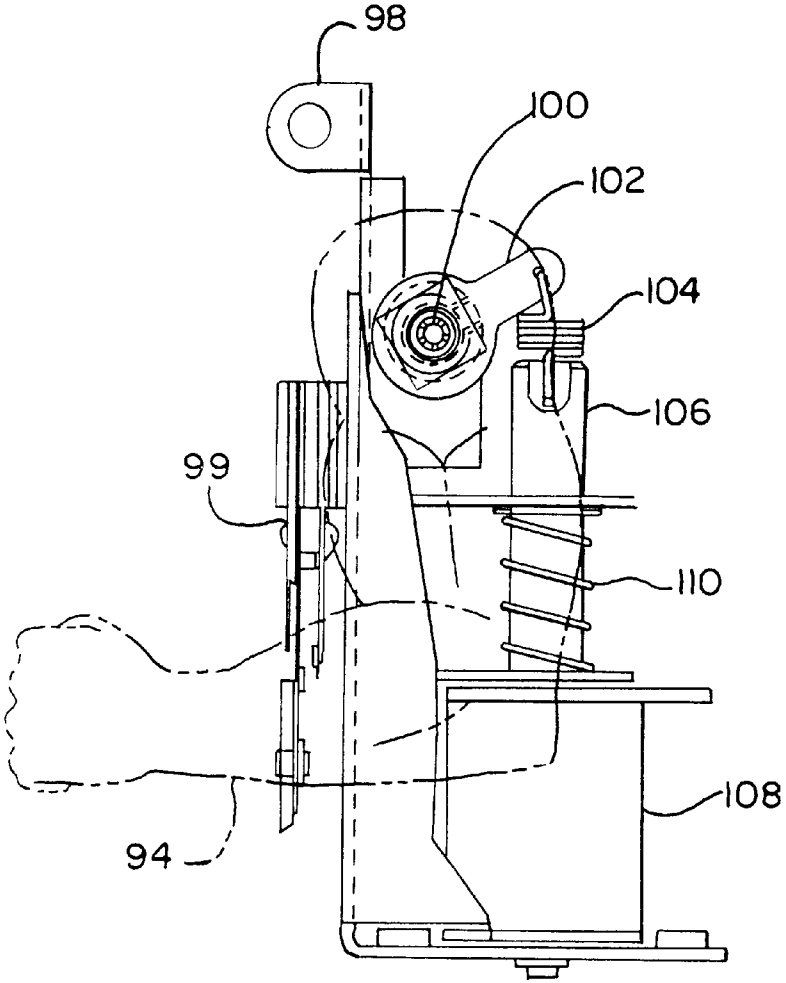

The articulation of one of the arms 94 is shown in FIGS. 5A and 5B. Arm 94 is connected to support 98 by a pin 100 so as to pivot. A lever 102 is attached to arm 94 with its distal end connected via spring 104 to plunger 106. Plunger 106 is engaged by solenoid 108. As a result, when solenoid 108 is energized, plunger 106 is pulled downwards against compression spring 110 and arm 94 is raised, as shown in FIG. 5B. When the supply of electricity to solenoid 108 is terminated, arm 94 returns to its original position (FIG. 5A). Operation of solenoid 108 is directed by the game microprocessor. Each of the two arms features its own solenoid and linkage as described above.

While the preferred embodiments of the invention have been shown and described, it will be apparent to those skilled in the art that changes and modifications may be made therein without departing from the spirit of the invention, the scope of which is defined by the appended claims.

What is claimed is:

1. A play feature for a pinball game, where the pinball game has an inclined playfield for supporting the movement of a game ball thereon and player controlled means for directing the movement of the game ball, comprising:

a) a multimode target including:

i) at least two distinct targets adapted to be rotatably mounted to said playfield and spaced so that only one target is in play at a time;

ii) means for rotating said multimode target with respect to said playfield to control which of said targets may be accessed by said game ball; and b) at least one variable trajectory ball ramp positioned so that said game ball may be directed from the playfield up said ramp towards said multimode target at a direction and speed that is determined by an initial direction and speed of the game ball as it rolls onto said ramp.

2. The play feature of claim 1 wherein said ramp surface is curved and banked towards said multimode target.

3. The play feature of claim 1 wherein said multimode target oscillates during game play so that increased player skill is required to strike it.

4. The play feature of claim 1 wherein said multimode target includes a moving barrier that interferes with a player's ability to strike an accessible one of the at least two distinct targets.

5. The play feature of claim 3 wherein said multimode target includes a moving barrier that interferes with a player's ability to strike the accessible one of the at least two distinct targets.

6. The play feature of claim 1 wherein one of the at least distinct targets includes a plurality of sub-targets.

7. A play feature for a pinball game, where the pinball game has an inclined playfield for supporting movement of a game ball thereon and player controlled means for directing the movement of the game ball, comprising:

a) a multimode target including:

i) an initial target adapted to be positioned upon said playfield;

ii) an alternative target adapted to be positioned upon said playfield and attached to said initial target so that said initial and alternative targets move as a unit;

iii) means for simultaneously rotating said initial target out of play and said alternative target into play; and b) a ramp on which said game ball may be directed at said multimode target.

8. The play feature of claim 7 wherein said ramp means is curved and banked towards said multimode target so that the game ball is projected towards said multimode target at a direction and speed that is determined by an initial direction and speed of the game ball as it rolls onto said ramp.

9. The play feature of claim 7 wherein said multimode target oscillates during game play so that increased player skill is required to strike it.

10. The play feature of claim 7 wherein said multimode target includes a moving barrier that interferes with a player's ability to strike it.

11. The play feature of claim 9 wherein said multimode target includes a moving barrier that interferes with a player's ability to strike it.

12. The play feature of claim 7 wherein said alternative target includes a plurality of subtargets.

13. A play feature for a pinball game, where the pinball game has an inclined playfield for supporting the movement of a game ball thereon and player controlled means for directing the movement of the game ball, comprising:

a) a multimode target having an initial target and an alternative target, said multimode target adapted to be rotatably mounted to said playfield to permit said initial and alternative targets to be selectively put into play; and b) at least one variable trajectory ball ramp positioned so that said game ball may be directed from the playfield up said ramp towards said multimode target at a direction and speed that is determined by an initial direction and speed of the game ball as it rolls onto said ramp.

14. The play feature of claim 13 wherein said ramp surface is curved and banked towards said multimode target.

15. The play feature of claim 13 wherein said multimode target oscillates during game play so that an increased player skill level is required to strike it.

16. The play feature of claim 13 wherein said multimode target includes a moving barrier that interferes with a player's ability to strike it.

17. The play feature of claim 15 wherein said multimode target includes a moving barrier that interferes with a player's ability to strike it.

18. The play feature of claim 13 wherein said alternative target includes a plurality of sub-targets.

* * * * *